United States Patent [19]

Jacobsson

[11] 4,247,057

[45] Jan. 27, 1981

[54] THREAD-STORAGE AND DELIVERY DEVICE

[75] Inventor: Kurt A. G. Jacobsson, Ulricehamn, Sweden

[73] Assignee: Aktiebolaget IRO, Ulricehamn, Sweden

[21] Appl. No.: 38,565

[22] Filed: May 14, 1979

[30] Foreign Application Priority Data

May 18, 1978 [DE] Fed. Rep. of Germany ..... 2821725

[51] Int. Cl.[3] ..... B65H 51/20

[52] U.S. Cl. ..... 242/47.01

[58] Field of Search ..... 242/47.01, 47.08, 47.09, 242/47.12, 47, 82; 66/132 R, 132 T; 139/452

[56] References Cited

U.S. PATENT DOCUMENTS

| | | | |
|---|---|---|---|
| 2,755,916 | 7/1956 | McIlvried et al. | 242/47.12 |
| 2,874,918 | 2/1959 | Steiber | 242/82 |
| 3,078,055 | 2/1963 | Harris | 242/47.12 |
| 3,099,412 | 7/1963 | Nystrom | 242/47.01 |
| 3,120,355 | 2/1964 | Bowman | 242/47.12 |
| 3,241,780 | 3/1966 | Kitselman | 242/47.12 |
| 3,796,385 | 3/1974 | Jacobsson | 242/47.01 |
| 3,938,751 | 2/1976 | Kawakami et al. | 242/47.01 |
| 4,059,240 | 11/1977 | Laursen | 242/47.01 |
| 4,065,066 | 12/1977 | Swett et al. | 242/47.12 |

FOREIGN PATENT DOCUMENTS

| | | | |
|---|---|---|---|
| 2357452 | 1/1975 | Fed. Rep. of Germany | 242/47.01 |

*Primary Examiner*—Stanley N. Gilreath

*Attorney, Agent, or Firm*—Blanchard, Flynn, Thiel, Boutell & Tanis

[57] ABSTRACT

A thread-storage and delivery device for a textile machine having a positive storage for positive thread delivery to the textile machine and a compensating storage for intermittent thread delivery to the machine. A thread drum of the positive storage and a storage drum of the compensating storage are arranged coaxially to one another. The withdrawal area of the storage drum and the winding-up area of the thread drum are arranged axially adjacent to one another, which causes the thread to transfer directly from one drum over to the other. In the transfer area there is mounted a support member which permits the movement of the thread in a peripheral direction. The winding directions of both drums are opposite to one another and both drums are moved relative to one another with a peripheral speed which, as an average over the operating time, corresponds approximately to twice the thread-delivery speed of the positive storage.

9 Claims, 4 Drawing Figures

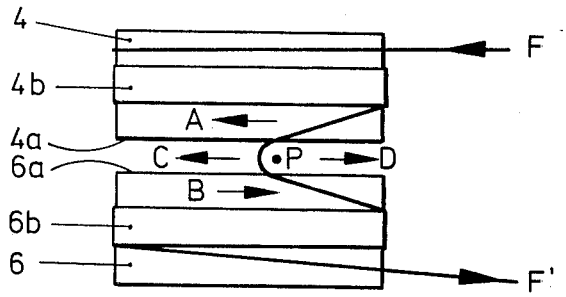
FIG. 2
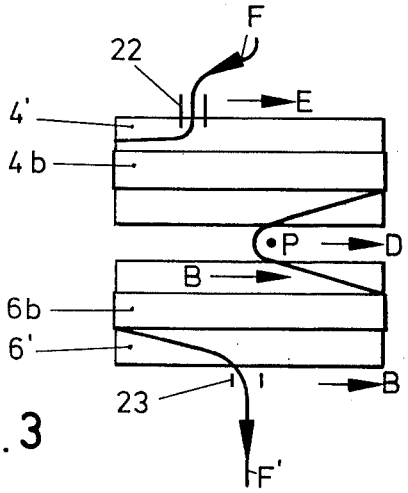
FIG. 3
FIG. 4
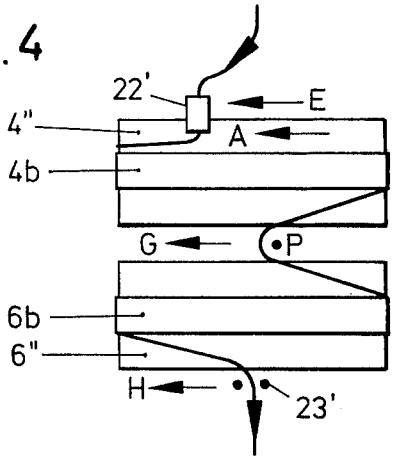

THREAD-STORAGE AND DELIVERY DEVICE

FIELD OF THE INVENTION

The invention relates to a thread-storage and delivery device having a storage for positive thread supply preceded by a storage for intermittent thread supply.

BACKGROUND OF THE INVENTION

Such a device is known from U.S. Pat. No. 4,059,240. It has a hollow axle, on which the storage drum of the intermittent storage is stationarily supported and the thread drum of the positive storage is rotatably supported. The thread which comes from a thread storage is fed to the storage drum by means of a winding-up member which rotates about said storage drum, and the thread is then pulled off overhead through the hollow axle. During its exit from the hollow axle the thread is guided through suitable guide members, is wound onto the thread drum of the positive storage and is pulled off from same tangentially. The two drums are thereby associated with one another such that the storage drum faces with its thread-supply area the thread drum, and same with its thread-removal area faces the storage drum, which results in a favorably short thread path from the storage drum to the hollow axle and from the hollow axle to the thread drum. The winding directions on both drums are the same; there exists the possibility to drive the winding-up device for the storage drum and the thread drum with one common drive, or upon exceeding a predetermined minimum storage size on the storage drum to uncouple same and to drive the positive storage alone. The known device is constructed compactly and space-savingly. However, the thread experiences on its way from the storage drum toward the thread drum several reroutings, for which suitable shapes of the drums or special guide members are needed.

The purpose of the invention is to construct a device of the abovedescribed type so that between both drums there is possible a thread transfer which is as short and direct as possible, and the thread is rerouted little.

In the inventive thread-storage and delivery device, the thread runs from the withdrawal or removal area of the storage drum on the shortest path to the thread drum. It experiences thereby one single rerouting, namely by the support member. The goal which is desired by the storages which are connected one behind the other is therewith achieved in a particularly high degree, namely to hold the thread tension at the positive storage as low and constant as possible.

During the thread transfer from the storage drum to the thread drum, only so much thread can be wound up onto the thread drum as is being unwound from the storage drum. Assuming the same drum diameters, this means theoretically that one winding is unwound from the storage drum. This, however, assumes that a nonelastic, nonexpandable thread is being used. An expandable thread is expanded depending on its elasticity during removal from the storage spool and during winding up onto the storage drum under tension. During an approximately tensionless transfer from the storage drum to the thread drum the expansion stops, the thread is shortened more or less depending on its elasticity. A winding on the thread drum receives therewith more threads than a winding on the storage drum. In order to achieve an even delivery, the relative peripheral speeds of both drums can be designed such with respect to one another, that the unwinding speed of the thread which comes from the storage drum is higher for a compensating speed which compensates for length changes of elastic threads during the transfer to the thread drum than the winding-up speed of the thread drum. It is assured therewith, that the thread storage on the positively delivering thread drum has substantially always the same size.

The thread transfer from the storage drum to the thread drum can occur in a simple manner through the support member by the storage drum being connected to a drive mechanism which controls its average peripheral speed: peripheral speed of the thread drum plus compensating speed. Such a drive control is for example possible with semiconductors, which operate dependent from a monitoring device of the thread storage on the storage drum. The speed of the storage drum, which is higher for the compensating speed, thus makes it possible, that the ideal transfer point between both drums, which lies on the support member, remains as much as possible stationarily with respect to the surroundings. If the speed differences between the drum rotations are temporarily greater than this, as made necessary by the thread elasticity, the transition point can wander. It moves thereby corresponding with the running direction of the thread, which belongs to the drum, which is quicker relative to its speed corresponding with the actual thread run.

As a support member it is possible to arrange advantageously a brake ring with elastic fingers on the storage drum. It assures even tension during removal of the thread from the storage drum and permits in a simple manner that the ideal transition point between both drums, which simultaneously represents the withdrawal point of the compensating storage and the feed point of the positive storage, can wander relatively to its surrondings.

An even thread delivery and an adjusting of the thread storages to both drums is assured in a simple manner by the storage drum of the compensating storage having associated with it a feed member which moves with respect to the storage drum, and the thread drum of the positive storage having associated with it a withdrawal member which is movable synchronously with the feed member. This means in each case at a rotating drum a stationary member, at a stopped drum a synchronously rotating member, for example a socalled flyer. Also possible is a flyer which rotates around a rotating drum in the same direction of rotation at twice the speed, or in the opposite direction at normal speed, when the drum rotates twice as fast. It is thereby true for the storage drum and a winding-up member, that the speed of the winding-up member must correspond with the speed of the thread which unwinds from the thread drum; the storage drum, however, in the transfer area gives its unwinding thread the necessary compensating speed.

In a different embodiment, the storage drum rotates only with a compensating speed; here a rotating winding-up member is associated, and the thread drum rotates in the same direction of rotation as the winding-up member and with approximately twice the speed and has a withdrawal member which rotates at the speed of the winding-up member. The relative speed between the withdrawal area of the storage drum and the winding-up area of the thread drum corresponds in this manner again approximately with the thread-delivery speed, which occurs in the case of the embodiment with two oppositely rotating drums in the transition area. In this device the transfer point wanders relative to its surroundings, namely in the direction which corresponds with the direction of rotation of the thread drum, at approximately half the peripheral speed of the thread drum. The thread drum winds in this manner during two rotations one winding on itself, thus as much as the withdrawal member which rotates at half the speed removes. From the storage drum is unwound during the same time so much more than one winding, as is necessary for balancing out the thread elasticity.

Furthermore in one embodiment it is possible to drive the storage drum for rotation and the storage drum can have a winding-up member which rotates in the same direction of rotation at half the speed of rotation, and the thread drum of the positive storage can stand still and can have a withdrawal member which rotates in the same direction and equally fast as the winding-up member. The withdrawal point wanders also in this device, namely in direction of rotation of the storage drum at approximately half the peripheral speed. The necessary compensating speed for the thread in the transfer area results from the control of the storage drum in dependency of its thread storage size.

BRIEF DESCRIPTION OF THE DRAWINGS

FIG. 2 is a schematic illustration of the thread course in a device with oppositely running storage and thread drums.

FIG. 3 is a schematic illustration of the thread course in a device with a stationary storage drum and a rotating thread drum for an ideal nonelastic thread.

FIG. 4 is a schematic illustration of the thread course with a rotating storage drum and a stationary thread drum.

DETAILED DESCRIPTION

Figure 1:
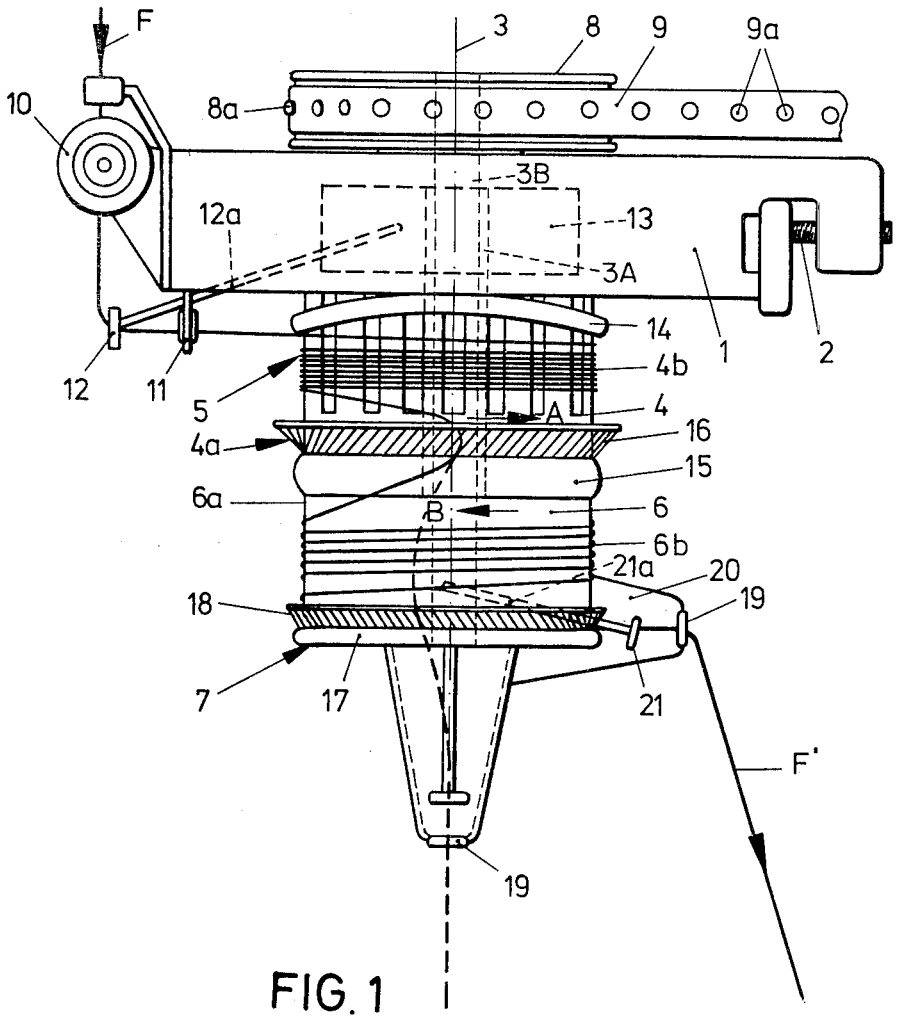
FIG. 1 is a front view of the inventive thread-storage and delivery device.

The thread storage and delivery device according to FIG. 1 has a mounting member 1 with a fastening mechanism 2. A storage drum 4 of an intermittent storage, which as a whole is identified with reference numeral 5, and a thread drum 6 of a positive storage, which as a whole is identified with reference numeral 7, each of which are supported on the mounting member 1 by means of coaxial shafts 3A and 3B which are indicated by their common center line 3. The shaft 3B carries a driving gear 8 on its end which is opposite to the drums and which projects beyond the mounting member. Said driving gear 8 is connected to a perforated driving belt 9 through pins **8*a* which are arranged on the periphery of said driving gear. The holes 9*a* grip thereby over the pins 8*a*. The driving gear 8, through shaft 3B drives the thread drum 6 of the positive storage 7. The storage drum 4 of the compensating or intermittent storage 5 has a separate drive via the other shaft 3A, which drive is indicated schematically at 13. The drive 13 (which can be an electric motor) can be controlled in dependence on the storage size on the storage drum 4 by means of an annular tiltable disc member 14 journalled on the storage drum shaft, which member monitors or senses the storage size on the storage drum 4 and co-acts with electronic switches, preferably tyristors, for quickly switching said drive 13** on and off when the storage size falls below a predetermined minimum amount and exceeds a predetermined maximum amount respectively, all this being thoroughly disclosed in U.S. Pat. No. 3,796,385.

A disk brake 10 and a stationary guide eye 11 are arranged on the mounting member 1 for engaging the thread F which is to be guided toward the intermittent storage 5. The thread F also runs through a shut-off or stop means 12, which is supported on a switching arrangement (not shown) by means of a swivel arm **12*a***.

The storage drum 4 is surrounded by a bead 15 at its withdrawal area, which does not face the mounting member and faces the directly adjacent thread drum 6, on which bead 15 is supported a brake ring 16 with elastic fingers. The brake ring 16 forms a support member for the thread which runs from the storage drum 4 to the thread drum 6. The direction of rotation of the storage drum 4 is indicated by the arrow A.

The thread drum 6 is rotated by its shaft 3B in the direction of rotation B opposite to the direction of rotation A of the storage drum 4. Accordingly the thread windings run on the thread drum 6 opposite to the winding direction on the storage drum 4. The feed area **6*a* of the thread drum 6 directly follows the removal area 4*a* of the storage drum. The thread drum 6 carries on its end area, namely its withdrawal area, a brake ring 18 on a support edge 17, below the elastic fingers of which brake ring 18 runs the unwinding thread F'. A withdrawal eye 19 for the unwinding thread F' is associated with the positive storage 7, which withdrawal eye 19 is fastened on a pivotal mounting 20. In the normal position of the mounting 20, the withdrawal eye 19 causes a tangential unwinding of the thread F'. As illustrated by dashed lines in FIG. 1, the mounting 20 can be pivoted 90° if intermittent delivery is desired. The withdrawal eye 19 thus moves into a position in which it permits direct thread withdrawal from the storage drum 4 for a purely intermittent delivery. A pivotal eye 21 is arranged in the thread path between the brake ring 18 and the withdrawal eye 19, the swivel arm 21*a* of which eye 21 is also supported on the mounting 20**. It prevents winding of the thread back onto the thread drum during a tension drop in the thread which unwinds from the thread drum.

The schematic drawings of FIGS. 2 to 4 explain the operation of the device according to FIG. 1. The three embodiments of FIGS. 2 to 4 differ in which drum or drums are being driven. To simplify understanding, it is assumed that all three embodiments operate with an ideal non-elastic thread. Thus, it is assumed that the thread during winding up onto one of the two drums, during transfer and during removal, does not experience any change in length, regardless of whether it is tensioned or not. This results in the same amount of thread being removed from the storage drum 4 as is wound up onto the thread drum 6. Following the principal description of the operation, the difference during operation with an elastic thread will be discussed.

The operation of the device according to FIG. 1 will be discussed hereinafter in connection with the schematic drawing of FIG. 2. The storage drum 4 and the thread drum 6 are thereby each illustrated schematically through their circumference. The thread storage **4*b* or 6*b* which is provided on each drum is indicated by a rectangle but for parts of the first or last windings. The diameters of the drums 4 and 6 are the same, but the rotation and peripheral speeds, however, are directed oppositely, as is indicated by the arrows A and B. The areas of the two drums which are adjacent to one another, the withdrawal area 4*a*** of the storage drum and the feed area 6a of the thread drum, thus have a relative speed to one another, which corresponds to twice the peripheral speed.

FIG. 2 identifies schematically the transfer or transition point P at which the thread which comes from the storage drum 4 runs over the support member, namely through the brake ring 16, is diverted and runs toward the thread drum 6. In so far as in the case of the device according to FIGS. 1 and 2, the peripheral speed $v_4$ of the storage drum 4 equals the peripheral speed $v_6$ of the thread drum 6, so that P remains stationary relative to its surroundings. If the storage drum 4 runs quicker, then the point P wanders in the direction of arrow C; if the thread drum 6 runs quicker, then the point P wanders in the direction of arrow D, which causes the sizes in the thread storages 4b or 6b to change. This is valid, as stated above, for nonelastic threads. In the case of elastic threads, a slightly higher peripheral speed of the storage drum 4 is needed in order to compensate for the stretch of the thread.

The speed of the storage drum 4 can be controlled by means of a thread storage monitoring element 14, e.g. in the form of a tiltable disc journalled on the storage drum shaft and co-acting as disclosed in U.S. Pat. No. 3,796,385 with electronic switches, preferably tyristors, for quickly switching on and off the drive 13 of the storage drum 4, such as an electric three phase AC motor 13, in such a way that there will always be a guaranteed predetermined minimum quantity of thread on the storage drum 4, so that the thread drum 6 can never fully empty the storage drum 4. In practice, where the thread is elastic, such a drive control will thereby automatically give the storage drum 4 a slightly higher average speed than the one of the thread drum 6, i.e. the speed of the storage drum 4 will automatically be equal to the speed of the thread drum 6 plus the necessary compensation speed for balancing out the thread elasticity. In this manner the point P will also remain approximately stationary, on an average, relative to its surroundings, notwithstanding the thread being elastic.

FIG. 3 illustrates an embodiment of the device in which the storage drum 4' is theoretically stationary, and the thread drum 6' rotates in the direction of arrow B. The thread F is wound up onto the storage drum 4' by means of a rotatable winding-up member 22, the direction of rotation of which is indicated by the arrow E. Its winding-up speed is identified as $v_{22}$. The winding-up member 22 places yarn windings onto the storage drum 4' in the same direction, the same as results when the storage drum rotates in the opposite direction as in the case of the storage drum according to FIG. 2. The thread is withdrawn from the storage drum 4' by the rotation of the thread drum 6'. The thread drum 6' rotates in the direction of arrow B with a speed $v_{6'}$, which is twice the speed $v_{22}$. During the thread removal, the transfer point P wanders in the direction of arrow D relative to its surroundings with a speed $v_p$, which is half as fast as the speed $v_{6'}$. Thus, during each rotation of the thread drum 6', only one half winding is wound up, whereas during two rotations one whole winding is wound up. The removal of the thread F' from the thread drum 6' is controlled by means of a withdrawal member 23, which also moves in the direction of rotation B, however, at a speed $v_{23}$ which is half as fast as the speed $v_{6'}$. In this manner just as much thread is controllably removed from the thread drum 6' of the positive storage, as is fed to same.

When an elastic thread is used, namely in practice, it is necessary that the storage drum 4' rotates with a compensating speed. The transfer point P can therewith also, during the expansion or stretch of the thread, rotate at half the speed of the thread drum, so that the thread drum winds up just as much thread as is being pulled off from it. Through the compensating rotary movement of the storage drum in a direction opposite the direction of rotation of the winding-up member 22, an increased winding-up speed for the storage drum is obtained. Same is controlled by the drive control of the storage drum dependent on the thread storage size on the storage drum as earlier described.

The provision of a rotatable winding-up member associated with a substantially stationary drum to permit winding of a thread storage around the drum, as in this FIG. 3 embodiment, is well known so that a detailed description of the structure and operation is hence believed unnecessary. In this regard, reference is also made to U.S. Pat. No. 4,059,240, as owned by the assignee of this application, which discloses this arrangement therein, namely a stationary thread storage drum having a rotatable winding-up member associated therewith.

FIG. 4 illustrates a further embodiment of a thread storage and delivery device with a rotating storage drum 4'' and a stationary thread drum 6''. The storage drum 4'' rotates thereby in the direction of arrow A with a speed $v_{4''}$ and the thread is supplied with the help of the winding-up member 22', which is driven in the direction of arrow E in the same direction as arrow A, however, with a speed $v_{22'} = \frac{1}{2} v_{4''}$. The thread is wound in the transition area by the rotation of the storage drum 4'' onto the thread drum 6'', whereby the transfer point P wanders in the direction of arrow G with a speed which is half the speed of the rotation speed $v_{4''}$. The controlled removal of the thread from the thread drum 6'' occurs with the help of a withdrawal member 23' which rotates in the direction of arrow H with a speed of $v_{23'} = v_{22'}$.

When using an elastic thread, thus in practice, the winding-up member 22' must be rotated with the same speed as the member 23' which removes the thread from the thread drum; however, the relationship between the speed of the winding-up member 22' and the speed of the storage drum 4'' must be measured such that in the transfer area the necessary compensating speed is obtained. In this manner the transfer point P can rotate with a speed which corresponds with half the withdrawal speed from the thread drum 6''.

The provision of a rotatable thread withdrawal element associated with a stationary thread drum, as utilized in this FIG. 4 embodiment, is also well known so that a detailed description of the structure and operation of same is believed unnecessary. Reference is also made to the embodiment illustrated in FIGS. 3–5 of my earlier U.S. Pat. No. 3,908,921, also owned by the assignee of this application, wherein there is illustrated a thread delivery device employing a rotatable thread withdrawal element associated with a stationary thread drum.

In all embodiments according to FIGS. 2 to 4, a monitoring of the thread storage can take place on one of the two drums, because the storage supplies are changed substantially in the same degree. In storage drums, the control of which occurs in view of the compensating speed through the thread storage, the control takes place advantageously by means of a tiltable disc journalled on the storage drum shaft, as disclosed e.g. in U.S. Pat. No. 3,796,385.

Both drums can have a common drive within the scope of the invention whereby an electromagnetic coupling takes care of the reversed speed of the thread drum and the necessary speed difference during use of an elastic thread.

The thread drum 6 advantageously has a slightly smaller diameter than the storage drum 4 in order to obtain a better transition for the thread between the two drums. The speed difference which is necessary due to the thread expansion may then be smaller.

The embodiments of the invention in which an exclusive property or privilege is claimed are defined as follows:

1. In a thread storage and delivery device for a textile machine, said device including second thread storage means for effecting positive thread delivery to the textile machine and first thread storage means connected ahead of said second storage means for permitting intermittent delivery of thread to the textile machine, said first thread storage means including a first thread storage drum adapted to have thread windings stored therearound and having a thread wind-up member associated therewith, the wind-up member and the first drum being supported for relative rotation therebetween, said second thread storage means including a second thread storage drum adapted to store thread windings therearound and having a thread withdrawal member associated therewith, said first and second drums being arranged coaxially with respect to one another, comprising the improvement wherein the first thread storage drum has a thread withdrawal area adjacent one end thereof, the second thread storage drum having a thread wind-up area adjacent one end thereof, the withdrawal area of the first drum being arranged axially adjacent the wind-up area of the second drum so as to define a thread transfer area between said coaxially adjacent drums which permits the thread as withdrawn from the first drum to be transferred directly to and wound around said second drum, thread support means for engaging and deflecting the thread within the transfer area as the thread is transferred from the first drum to the second drum so that the thread is wound around the second drum in the opposite direction to the windings on the first drum, said support means having means for permitting the transferred thread to freely move along the transfer area peripherally relative to said drums, first drive means for effecting relative rotation between said first drum and said wind-up member at a first relative peripheral speed to effect winding of thread on said first drum, and second drive means for effecting relative rotation between said first and second drums at a second relative peripheral speed which on the average over the operating time of the device corresponds approximately to twice said first peripheral speed.

2. A device according to claim 1, wherein the support means comprises a ring which is coaxial with said drums and is located substantially therebetween in the vicinity of said transfer area, said ring having a plurality of elastic fingers arranged thereon and disposed for engaging and deflecting the transferred thread, said elastic fingers permitting the transferred thread to move peripherally of the transfer area relative to said drums.

3. A device according to claim 2, wherein the first drive means effects relative rotation between the first drum and the wind-up member at said first relative peripheral speed which is slightly greater than one-half the second relative peripheral speed to compensate for changes in length of the thread due to the elasticity thereof.

4. A device according to claim 1, wherein the first drive means effects relative rotation between the first drum and the wind-up member at said first relative peripheral speed which is slightly greater than one-half the second relative peripheral speed to compensate for changes in length of the thread due to the elasticity thereof.

5. A device according to claim 3 or claim 11, wherein the first drum has a diameter slightly larger than the diameter of said second drum to facilitate the transfer of thread therebetween and to also compensate for length changes in the thread due to elasticity thereof.

6. A device according to any one of claims 1, 2 and 4, wherein the thread withdrawal member associated with said second drum is supported so as to be movable synchronously therewith.

7. A device according to any one of claims 1, 2 and 4, wherein said first drive means causes rotation of said wind-up member, said second drive means is connected to said second drum for causing rotation thereof in the same direction as said wind-up member but at approximately twice the peripheral speed thereof, and said thread withdrawal member is supported for rotation relative to said second drum and is rotatably driven at substantially the same speed and in the same direction as said wind-up member.

8. A device according to any one of claims 1, 2 and 4, wherein the first drive means effects rotation of the wind-up member in a first rotational direction, said second drive means effects rotation of the first drum in the same rotational direction at a speed which is approximately twice that of the wind-up member, the second drum being maintained nonrotatable, and the thread withdrawal member associated with the second drum being rotatable in the same direction as the thread wind-up member and at substantially the same speed.

9. A device according to any one of claims 1, 2 and 4, wherein the wind-up member is nonrotatable, wherein said first and second drums are both supported for rotation, wherein said first drive means effects rotation of said first drum in a first rotational direction at said first peripheral speed, wherein said second drive means effects rotation of said second drum in the opposite rotational direction at a peripheral speed which substantially equals or is slightly less than the first peripheral speed so that the peripheral speed of the second drum relative to the first drum is substantially twice that of the first peripheral speed, the thread withdrawal member being mounted for synchronous movement with the second drum.

* * * * *

UNITED STATES PATENT AND TRADEMARK OFFICE

CERTIFICATE OF CORRECTION

PATENT NO. : 4 247 057

DATED : January 27, 1981

INVENTOR(S) : Kurt A. G. Jacobsson

It is certified that error appears in the above—identified patent and that said Letters Patent is hereby corrected as shown below:

Column 8, line 18; change "Claim 11" to ---Claim 4---.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*